United States Patent [19]

Hain et al.

[11] 3,948,559

[45] Apr. 6, 1976

[54] ADJUSTABLE CHAIR

[75] Inventors: Larry A. Hain, Columbia; Ronald C. Webb, Red Lion, both of Pa.

[73] Assignee: Dentsply Research & Development Corporation, Milford, Del.

[22] Filed: July 31, 1975

[21] Appl. No.: 600,766

Related U.S. Application Data

[63] Continuation-in-part of Ser. No. 551,873, Feb. 21, 1975, abandoned.

[52] U.S. Cl. ..... 297/330; 297/349; 297/423

[51] Int. Cl.[2] ..... A61G 15/00

[58] Field of Search ..... 297/330, 71, 316, 321, 297/349, 90, 91, 337, 68, 69, 423, 429, 84, 417

[56] References Cited

UNITED STATES PATENTS

| | | | |
|---|---|---|---|
| 3,245,220 | 4/1966 | Wenger | 297/423 |
| 3,486,789 | 12/1969 | Taylor | 297/417 |
| 3,661,421 | 5/1972 | Johnson | 297/417 |
| 3,774,965 | 11/1973 | Brandt | 297/330 |

*Primary Examiner*—Francis K. Zugel

[57] ABSTRACT

A chair of the type particularly adapted for use by dentists, ophthalmologists and the like but also useful for other purposes in which a back is pivoted relative to a seat and a leg rests extends outward from the seat. The seat with the back pivotally connected thereto is adapted to be moved about a vertical axis from a position in which the front to back axis of the seat is disposed in alignment with the longitudinal axis of the leg rest which projects laterally outward from one side of the base and a position in which said axis of the seat is transverse to said longitudinal axis of the leg rest in order to facilitate the seating of a person in the chair while the seat is in the latter position and then rotating the seat 90° to permit the person to dispose his legs upon the leg rest which preferably is stationary relative to the base of the chair.

The seat also is pivoted at its rear end and mechanism actuated by the pivoting of the back between a substantially upright position and a rearwardly extending inclined position causes the front edge of the seat to be elevated above the rear edge and thus, effects a sloping condition of the seat upon the base of the chair to contribute to the comfort of an occupant, especially when in the supine position upon the chair with the back extending substantially rearwardly from the rear edge of the seat.

10 Claims, 12 Drawing Figures

ADJUSTABLE CHAIR

REFERENCE TO RELATED APPLICATIONS

This application is a continuation-in-part of Ser. No. 551,873, filed Feb. 21, 1975, now abandoned.

Design Application, Ser. No. 533,733, filed Dec. 17, 1974.

BACKGROUND OF THE INVENTION

For many years, the normal type of dental chair was one in which a seat was mounted upon a base and hydraulic or other equivalent means were employed to raise and lower the seat relative to the base. A back was pivotally connected at its lower end to the rear end of the seat and was adapted to be moved from substantially upright position to a rearwardly and angularly inclined position relative to the horizontal. A foot rest, which was attached to the outer or lower end of a leg rest also was included, the leg rest being connected pivotally to the front end of the seat and, at least in recent years, when the back was moved from upright to inclined position, the leg rest was extended from perpendicular, depending position, to an angularly and forwardly extended position and the foot rest was usually moved from a perpendicular position relative to the leg rest to an outwardly extending substantially horizontal position.

When a patient was to be seated in a chair of the foregoing type, he usually could stand upon the foot rest and somewhat turn around to a limited extent while being seated in the chair. Chairs of this type, however, in the lowest position thereof, were relatively high and normally required a dentist to stand while performing dental operations in the oral cavity. In recent years, however, it has become very popular for a dentist, as well as a dental assistant, to be seated while operating upon a patient, thereby increasing the comfort to a dentist and dental assistant. However, this necessitated the development of dental chairs and the like which had a seat closer to the floor level than the seats of chairs which were popularly in use prior to that time. As a result, one very popular type of chair which was developed comprises the subject matter of U.S. Pat. No. 3,774,965, to Brandt et al., dated Nov. 27, 1973 and U.S. Pat. No. 3,823,979, to Davis, dated July 16, 1974. In these patents, however, the leg rest extended forwardly from and actually constituted and integral part of the seat and was rigid therewith. In order for a patient to be seated upon a chair of this type, it was necessary for the patient initially to sit upon the seat sideways and then raise his legs and turn himself through a substantially 90° arc in order to dispose his legs upon the horizontal extending leg rest of the chair seat. Hence, while these chairs have backs pivotally connected to the rear ends of the seats, when the back is moved from upright to inclined position, no corresponding movement of the leg rest occurs.

Another chair manufacturer, in attempting to adapt their products to the more modern mode referred to above, developed a chair in which the leg rest, while a continuation of the seat, nevertheless, was flexibly connected therewith in order that the outer end thereof might at least be moved through a limited angular arc from a downwardly inclined position of about 45° to the horizontal, to a substantial horizontal position. Such chair comprises the subject matter of U.S. Pat. No. 3,486,789 to Taylor et al., dated Dec. 30, 1969.

This chair complied substantially with the so-called "low profile" mode which was being introduced to the dental profession at the time of such development of the chair, but in order to have a patient seat himself in the chair, such seating initially took place sideways with respect to the seat and then the patient had to move himself through an arc of about 90° to dispose his legs upon the leg rest, when the latter was in the initial position.

Particularly in regard to female patients, many of whom wear short skirts at the present time, as well as for other purposes set forth in detail hereinafter, the seating of patients upon chairs in which the leg rest is either rigid with the seat or a substantial continuation thereof, as in the Taylor et al. patent, room for improvement has been found to exist by the inventor of the invention comprising the subject matter of the instant application, details of which are set forth hereinafter.

In regard to the feature of moving a dental seat and the back connected thereto relative to a leg rest in a chair of the type normally employed by dentists or similar corresponding uses, it has been found that no very close development has occurred as far as the patented art is concerned. It is well-known that in the art of mechanic's or draftsman's chairs, particularly those which have a seat disposed at an abnormally high location with respect to a supporting floor, such as chairs somewhat resembling bar stools in height, it has been somewhat common to provide foot rests extending outwardly from the supporting pedestal for the chair seat so that a person seated upon this chair or stool conveniently could at least support their heels upon such foot rests. Typical examples of this type of chair or stool are found in the following exemplary patents:

| | | | |
|---|---|---|---|
| U.S. Patent No. | 1,590,240 | Gorton | June 29, 1926 |
| | 1,723,363 | McArdle | Aug. 6, 1929 |
| | 2,437,940 | Cramer et al | Mar. 16, 1948 |
| | 2,439,869 | Sharp | April 20, 1948 |
| | 3,820,844 | Fortnam | June 28, 1974 |

Particularly when tilting the back of a chair, such as one of the types normally employed by dentists and the like, it has been customary for a number of years to raise the front portion of the seat a limited distance when the back is moved from substantially upright to a rearwardly inclined position. Such movement of the forward portion of the seat to a higher elevation under such circumstances has been accomplished in various ways, many of which are relatively complex, such as illustrated in the following exemplary patents:

| | | | |
|---|---|---|---|
| U.S. Patent No. | 2,714,922 | McKibban et al | Aug. 9, 1955 |
| | 2,859,799 | Moore | Nov. 11, 1958 |
| | 3,056,629 | Fletcher | Oct. 2, 1962 |
| | 3,142,509 | Ehrke et al | July 28, 1964 |
| | 3,381,997 | Fritz et al | May 7, 1968 |
| | 3,804,460 | Leffler | April 16, 1974 |

Accordingly, it has been found that there is room for improvement in regard to structures for tilting the seat upwardly at the forward end when the back is inclined toward a rearward position, and such more simple improvements are set forth hereinafter.

SUMMARY OF THE INVENTION

It is the principal object of the invention to provide a chair of the type adapted to be employed by dentists, as well as by other medical practitioners, such as ophthalmologists and the like who perform examination and treatment procedures on patients while seated in such chairs, the principal feature of the chair comprising the arrangement of a leg rest which extends laterally outward from the upper part of a base structure, a seat also supported by the proper portion of said base and having a back pivotally connected at its lower end to the rear end of said seat, said seat and pivotally connected back being rotatable about a substantially vertical axis extending upwardly from the base, such movement being permitted preferably through an arc of 180°, whereby the front of the seat may be disposed respectively at opposite sides of the longitudinal axis of the leg rest to establish an initial position of the seat in a manner in which the front end of the seat is unencumbered by the leg rest and a patient may readily be seated upon the same, particularly when the seat is in its lowermost position upon the base structure, whereby an attendant may then rotate the seat with the patient in it in a direction so that the patient may dispose his legs upon the leg rest without having to rotate himself upon the seat as is required at present in regard to popular types of dental chairs, such as those referred to above.

It is another object of the invention ancillary to the foregoing object to have a patient seated in the chair while the seat is arranged with its front edge disposed at one side or the other of the longitudinal axis of the leg rest, and while the back preferably is in the upright position, whereby the patient is disposed in a much more comfortable and practical position for purposes of flexing and inserting x-ray film in the oral cavity or removing the same therefrom after exposure to x-rays due to the fact that the attenant who is placing or removing the x-rays relative to the oral cavity is not encumbered by the leg rest, and in particular, may directly face the patient for such and similar activities, such posture and arrangement not being possible when a patient is seated in chairs of conventional type, such as those referred to above.

A further object of the invention is to provide relatively simple means operable to elevate the forward end of the seat a limited distance and thereby, slope the seat rearwardly and downwardly when the back is moved from an upright position to a rearwardly inclined position, such movement of the seat being caused by the pivotal movement of the back relative to the seat.

Further details, such as control means, actuating mechanism and other mechanisms which are associated with the foregoing objectives are set forth in detail hereinafter and are illustrated in the accompanying drawings comprising part of the application.

GENERAL DESCRIPTION

Figure 1:
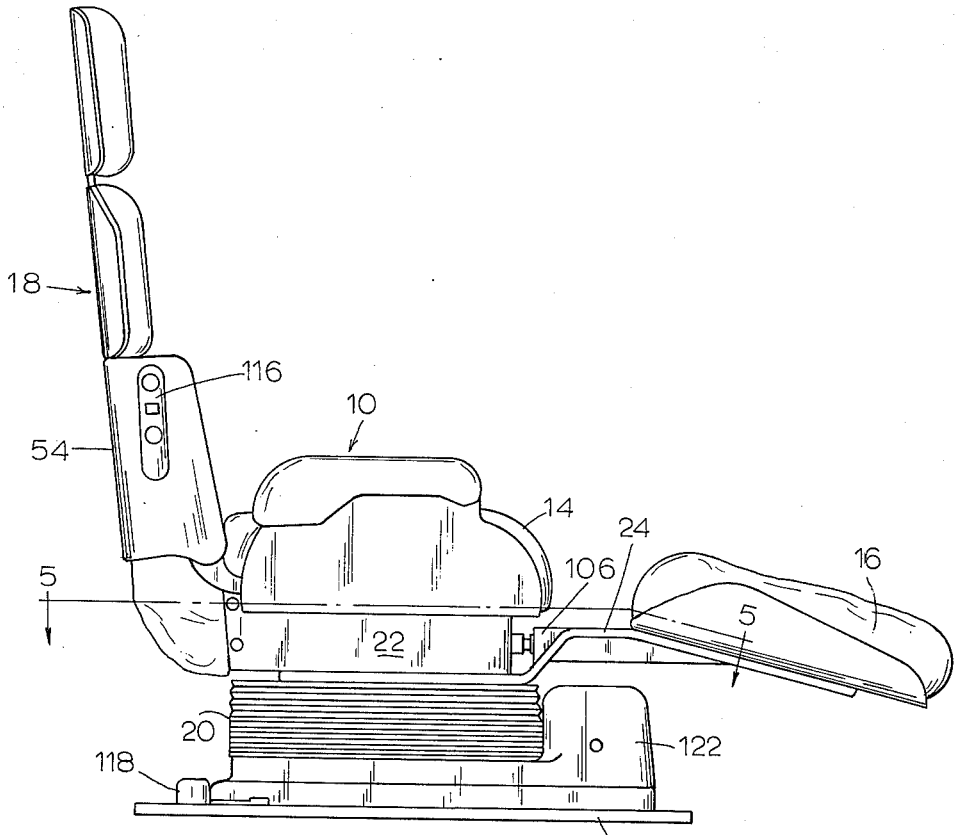
FIG. 1 is a side elevation of an exemplary chair embodying the principles of the present invention, the seat being illustrated with its front to back axis in alignment with the longitudinal axis of the foot rest.

For purposes of simplifying the description of the present invention, a dental chair has been selected for illustration in the drawings of the application, such chair being representative, however, of a number of different chairs, such as may be used for other medical examinations or treatment purposes, as well as for use in other activities, such as being employed in beauty parlors and other occupations in which it is desirable for the person seated in the chair to be moved, as desired between upright and rearwardly inclined or supine positions. Therefore, in the following description, it is to be understood that the basic principles of the invention may be applied to chairs other than those indicated strictly for dental purposes, even though such use is one of the principal uses in which the present invention is advantageous.

Figure 2:
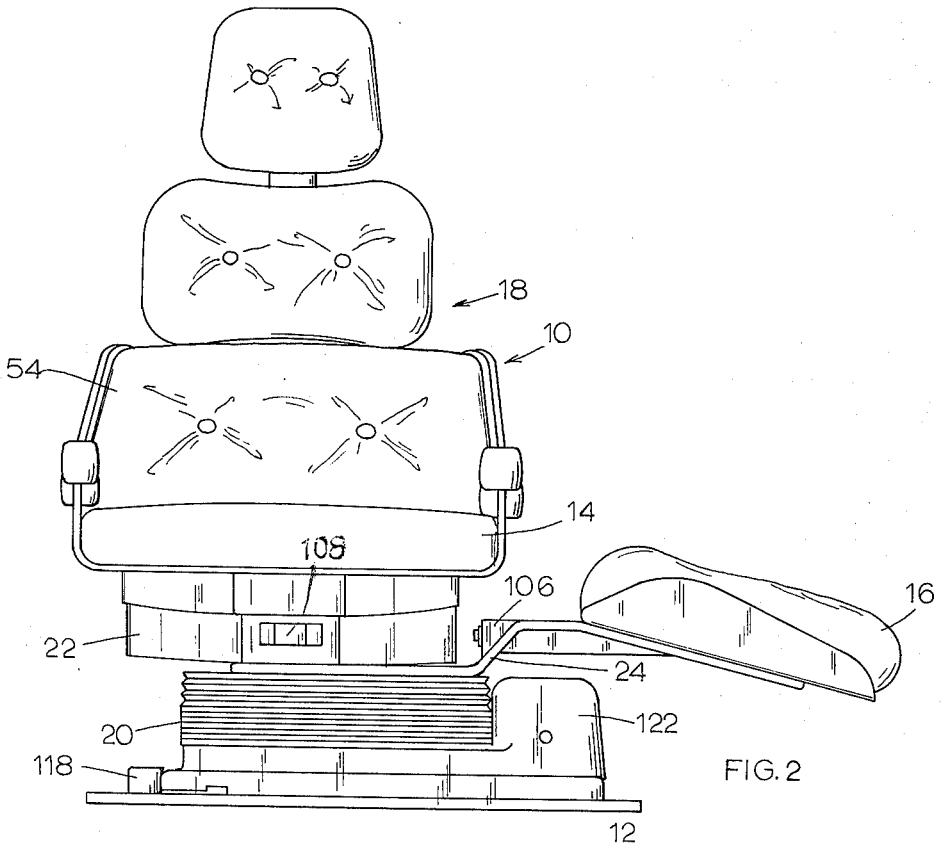
FIG. 2 is a vertical elevation of the chair shown in FIG. 1 with the base and leg rest in the same position as shown in said figure but with the seat and back having been rotated 90° from the position shown in FIG. 1 so as to dispose the front end of the seat to be free of obstruction by the leg rest.

Referring to the drawings, especially FIGS. 1 and 2, a complete chair assembly 10 is illustrated, the principal components thereof comprising a base plate 12, which is adapted to be mounted upon a supporting surface such as a floor in an operatory or the like, a seat 14 which is illustrated as being upholstered, a leg rest 16 which also is upholstered, a multi-sectioned back 18, which is pivotally connected at its lower end to the rear end of the seat 14, and seat-elevating means 20, which is disposed upon the base plate 12 and the seat 14 is connected to the upper end thereof for purposes of raising and lowering the seat, as well as the back 18, which is pivotally connected thereto, to various desired positions of elevation. As illustrated in FIGS. 1 and 2, the seat 14 is illustrated in its lowest intended position. Details of the seat-elevating means 20 are not illustrated for purposes of simplifying the drawings, such mechanism comprising the subject matter of an additional application now being prepared and owned by the assignee of the present invention.

The seat 14 includes a rotatable base unit 22, details of which are illustrated in subsequent figures of the drawings, said unit being rotatable through an arc of at least 180°, about a vertical axis perpendicular to the base plate 12, such rotation being relative to the upper surface of a preferably rigid bracket plate 24, which is fixed to the upper end of seat-elevating means 20, and therefore, is raised and lowered with the seat 14 and rotatable base 22 as the mechanism within the seat-elevating means 20 is operated between the opposite limits comprising the lowest and highest positions of the seat 14 and the mechanism which is movable therewith as the same is raised and lowered.

Figure 4:
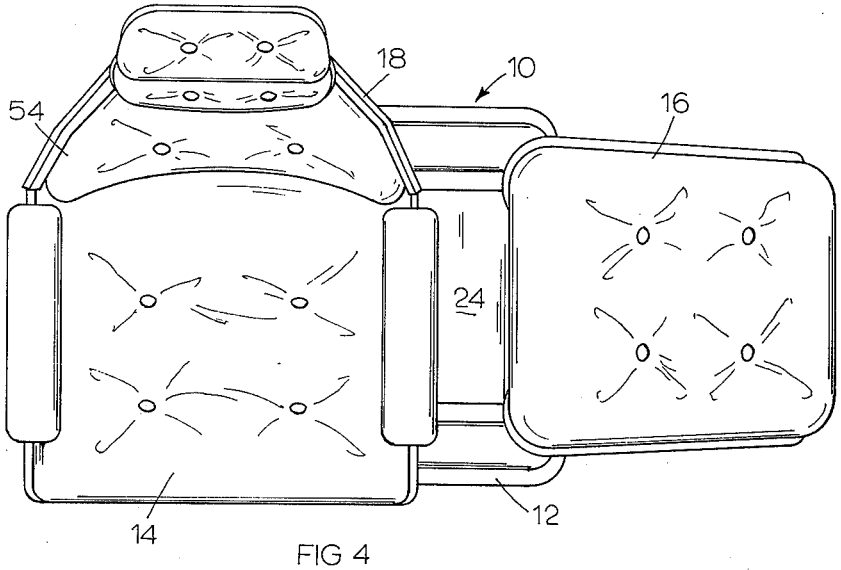
FIG. 4 is a top plan view of the chair arranged in the position shown in FIG. 2 in which it will readily be seen that the front end of the seat is free of obstruction for the seating of a patient therein.

One of the principal advantages afforded by the present invention comprises the fact that seat 14 may be disposed initially in the position shown in the plan view comprising FIG. 4, in which the front edge of the seat is disposed in parallel relation to the longitudinal axis of the leg rest 16. This position of the seat 14 may be referred to as a side position thereof and the same relative position is shown in vertical elevation in FIG. 2. When in this position, it will be seen that the leg rest 16 is positioned adjacent one side of the seat 14 so that it offers no obstruction when a person desires to be seated upon the seat 14 which may be accomplished by initially standing in front of the seat 14 when in the position shown in FIGS. 2 and 4, lowering himself into the seat, and then extending his legs outwardly while the operator or occupant rotates the seat with the person in it substantially 90° so that the person may dispose his legs immediately above the leg rest 16 and then lower his legs onto said leg rest. This manner of seating a person in the chair initially, as well as the person positioning his legs upon the leg rest, is accomplished much more comfortably than is possible when a person is being seated in conventional chairs, especially of a dental type, in which the seat is not rotatable about a vertical axis relative to the leg rest. Further, when a person is seated in the chair with the seat 14 disposed in the position shown in FIGS. 2 and 4, particularly when the chair is used for dental purposes, such as taking impressions of the oral cavity, taking x-ray photographs, and the like, the dentist or attendant is in a much more advantageous position of undertaking such procedures than when a conventional dental chair is used, such as one in which the seat is non-rotatable about a vertical axis relative to the leg rest. Further, when in this position, a person seated in the chair may rest his feet firmly upon the floor and thus, greatly steady himself during the aforementioned procedures and therefore, further facilitate the undertaking of the same by a dentist or attendant.

As mentioned heretofore, the pivotal mounting of the seat 14 for movement about a vertical axis preferably should extend through an arc of no less than 180°. Referring to FIG. 4, it will be seen that the seat 14 faces one side of the chair assembly but said seat is rotatable, counterclockwise, as viewed in FIG. 4, so that the outer edge thereof is disposed adjacent the opposite side of the chair assembly, whereby a person may be seated in the chair from either side thereof and then the chair may be rotated to disposed the legs of the person in alignment with the leg rest 16.

SEAT CONSTRUCTION

Details of the seat construction are best illustrated in FIGS. 5—9 and 12. Of these figures, attention is particularly directed to FIGS. 6 and 8 in which it will be seen that said seat construction is supported upon a rigid bracket plate 24 which has one flat end securely fastened to the upper portion of seat elevating means 20 of the chair base assembly 10. An intermediate portion of plate 24 is offset upwardly, for purposes to be described, and the opposite end of plate 24 slopes slightly downward and outward to support leg rest 16 in a restful position for a patient. The seat comprises a mounting plate 26 that contains a bearing ring 28 fixedly connected thereto, by welding, for purposes of supporting the outer races of a plurality of anti-friction bearing units 30, the inner races of said units engaging the outer surface of a central tube 32 which has a horizontal bottom flange 34 thereon which is disposed in a shallow recess 36, see FIG. 6, formed in the lower surface of bracket plate 24 and suitably secured to the base thereof by screws 38.

Figure 6:
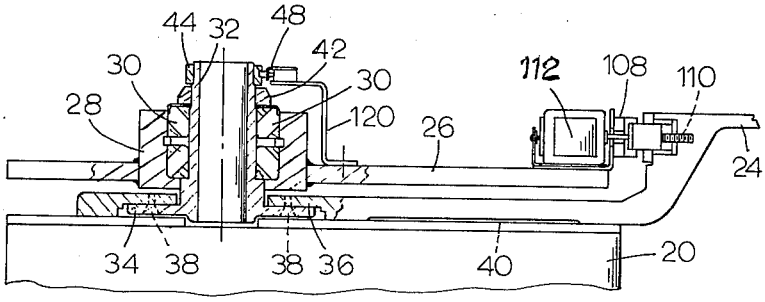
FIG. 6 is a side elevaton of the mechanism shown in FIG. 5 with the uppermost plate in said figure being removed.

The bracket plate 24 is affixed by suitable means, which are not shown in detail, to the upper support plate 40 which is shown in FIG. 6 and is affixed to the seat-elevating means 20, which preferably is enclosed within a vertically expandable shroud, illustrated in FIGS. 1 and 2.

The bearing units 30 are maintained within suitable seats in the bearing ring 28 by an upper clamping ring 42, which is suitably secured to the upper end of tube 32 by a set screw, not shown, or otherwise. Immediately above the clamping ring 42 is a circular switch-operating cam 44, which contains an actuating notch 46 that is engageable with the actuator of control switch 48, the function of which is described hereinafter.

Fixed to the rear portion of the mounting plate 26 adjacent opposite sides thereof is a pair of upwardly and rearwardly extending brackets 50, which contain apertures in the upper ends thereof for purposes of receiving pivot bolts 52. The lower section 54 of the multi-sectioned back 18 primarily is supported by a rigid plate 56, preferably formed from metal, and being provided with a pair of supporting brackets 58 respectively adjacent opposite sides of plate 56 slightly above the lower edge thereof. The forward ends of the brackets 58 contain threaded openings which are axially aligned with the bearing openings in the brackets 50 for purposes of receiving the pivot bolts 52, thereby pivotally connecting the back section 54 to the basic elements of the seat 14, especially the mounting plate 26 thereof.

Figure 8:
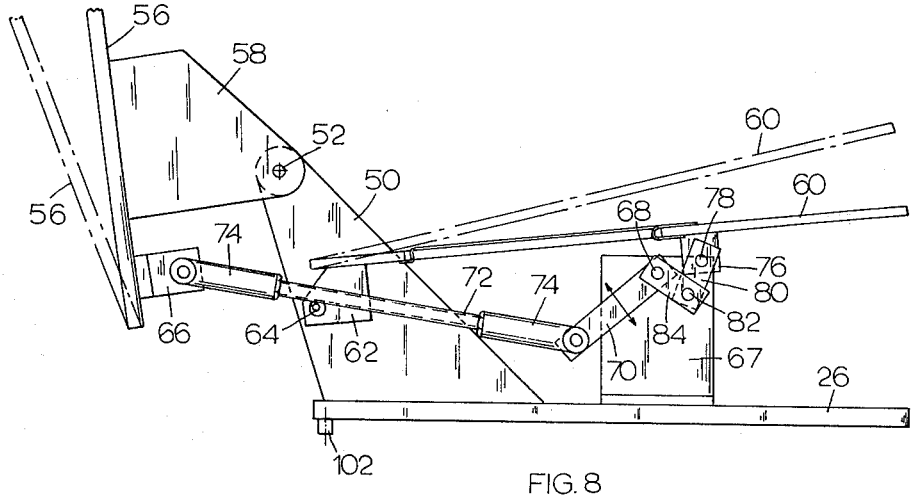
FIG. 8 is a fragmentary side elevation of the seat elevating mechanism comprising part of the present invention, one position of the back and seat being shown in full lines and an alternate position being illustrated in phantom.
Figure 9:
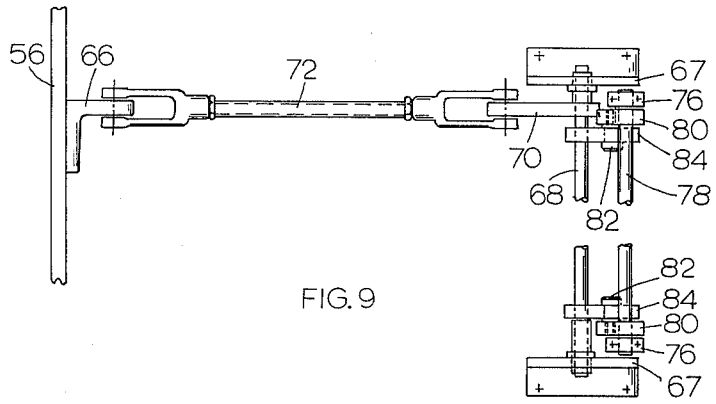
FIG. 9 is a fragmentary plan view of the basic elements of the seat elevating mechanism shown in FIG. 8.

Also pivotally supported by the brackets 50 on plate 26 is a cushion plate 60, the rear portion thereof, adjacent opposite sides of the plate 60 having ears 62 respectively fixed thereto and disposed vertically so as to be substantially parallel to the brackets 50. Pivot bolts 64 commonly extend through aligned openings in the ears 62 and brackets 50 for purposes of pivotally supporting the rear end of cushion plate 60 for a limited tilted positioning of the same with respect to the mounting plate 26, two alternate positions of the plate 60 being shown in FIG. 8, one being in full lines and the other in phantom. As explained in greater detail hereinafter, when the back 18 is disposed in rearwardly extending direction so as to arrange the patient in a supine position, it has been found to be more comfortable under such circumstances if the seat of a chair of the type to which the present invention pertains, is tilted downwardly toward the rear to a greater degree than when a person is seated upright in said chair with the back 18 correspondingly in substantially vertical position, or at least in the exemplary position shown in FIG. 1. Accordingly, the present invention provides for operating mechanism to accomplish this, details of which are as follows:

Rigid plate 56 of the lower section 54 of back 18, adjacent the lower end thereof and intermediately of the opposite edges thereof, is provided with a pivot bracket 66, which also is shown in FIG. 9. In addition, mounting plate 26, at transversely spaced locations thereon, is provided with a pair of vertical brackets 67, having bearing openings in the upper portions thereof which respectively receive opposite ends of a transverse crank shaft 68, as shown in FIGS. 8 and 9. A crank arm 70 is fixed to shaft 68 adjacent one end thereof. Connecting rod 72 has a clevis 74 connected to and projecting from opposite ends thereof, one of said clevises being pivotally connected to pivot bracket 66 on plate 56 and the other end being pivotally connected to the outer end of crank arm 70. It wll, thus, be seen that as the back 18 and its rigid plate 56 are moved about the axes of pivot bolts 52 in opposite directions, the crank arm 70 will be moved in corresponding opposite directions as indicated by the directional arrow shown in FIG. 8, similarly moving the crank shaft 68 therewith.

Cushion plate 60 also is provided with a pair of pivot brackets 76 which projects downwardly from the lower surface thereof respectively adjacent opposite side edges of the cushion plate 60 for purposes of supporting the opposite ends of transverse shaft 78 to which one end of a pair of connecting links 80 are attached. The opposite ends of said links 80 are apertured to receive pivot pins 82, said pivot pins also being connected respectively to one end of a pair of additional links 84, the opposite ends of which are rigidly fixed to the crank shaft 68, whereby the links 84 also function as crank arms. From the foregoing, it will be seen that when the lower section 54 of back 18 is pivotally moved relative to the axes of pivot bolts 52, connecting rod 72 actuates crank arm 70 which correspondingly moves links 84 in the nature of additional crank arms to cause similar movements of connecting links 80, and thereby, raise and lower the forward edge of the cushion plate 60 to effect its various tilted positions of the seat 14 as the same is pivotally moved about the axes of pivot bolts 64.

POWERED OPERATION OF BACK

Figure 5:
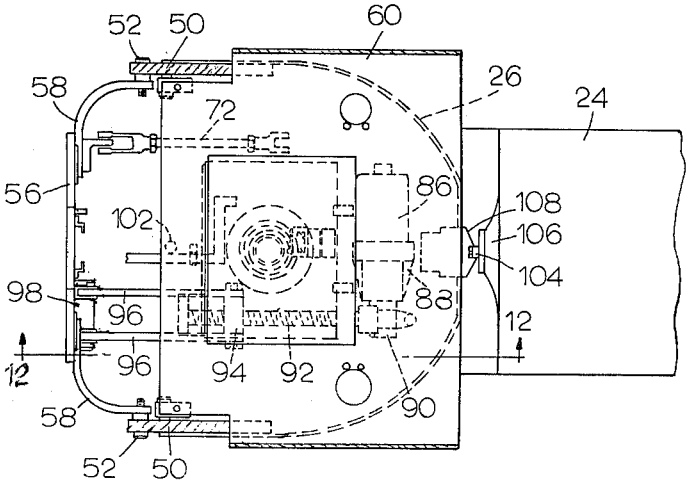
FIG. 5 is a fragmentary plan view of the powered operating mechanism disposed within the chair as seen substantially along the line 5—5 of FIG. 1 below the seat per se.
Figure 12:
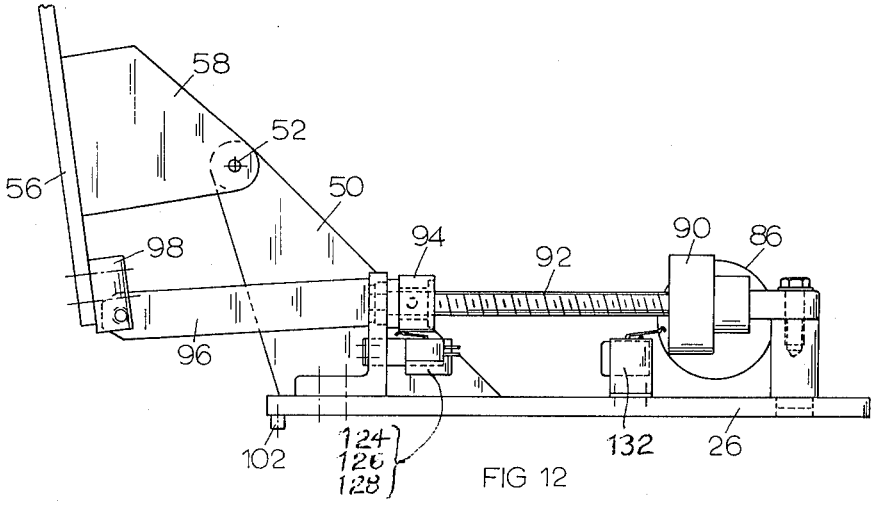
FIG. 12 is a fragmentary side elevation of the power means by which the back is pivotally moved relative to the seat, as viewed substantially on the line 12—12 of FIG. 5.

The mechanism for moving the back by means of powered mechanism is best illustrated in FIGS. 5 and 12. The illustration in plan view of the seat, as shown in FIG. 5, shows an electric motor 86, which is suitably mounted upon mounting plate 26 and has a gear reduction unit 88 connected thereto, together with a worm and worm gear unit 90, which provides further speed reduction for purposes of driving a screw 92. Preferably, the screw is of the type having coarse threads, such as the Acme threads. The screw 92 operates a nut 94, opposite sides of which comprise parallel faces to which one end of each of a pair of links 96 respectively are pivotally connected. The opposite ends of said links are connected to a pivot block 98 which is suitably fixed to the lower edge of plate 56 of lower section 54 of the back 18. As the screw 92 is rotated in opposite directions by the motor 86, it will be seen that the links 96 will move the plate 56 and, correspondingly, the rest of the elements of back 18 in opposite directions about the axes of the pivot bolts 52 by which the back and its elements are connected to the mounting plate 26 which, in turn, is supported upon bracket plate 24 for movement about a vertical axis.

From the foregoing, it will be seen that primary movement of the plate 56 of back 18 is effected by the motor 86, screw 92, nut 94 and links 96. Such movement is correspondingly transmitted through plate 56 to connecting rod 72 of the seat-tilting mechanism and thereby automatically moves the cushion plate 60 to different positions of angularity with respect to the horizontal as described above, and as illustrated especially in FIG. 8. Accordingly, only a single motor is required to effect both the movement of the back 18 and the seat 14, which is supported upon the cushion plate 60, the tilting of the cushion plate 60 to the various positions referred to being automatically accomplished by such movement of plate 56 of the back 18.

ROTARY SEAT CONTROL

Supporting the mounting plate 26 upon the central tube 32, which is fixed to bracket plate 24, has been described hereinabove. Also as described above, the cushion plate 60 to which the upholstered seat 14 is connected, as well as the plate 56 of the back 18, are both pivotally connected to the mounting plate 26 and rotate therewith about vertical axis of central tube 32. The rotation of the seat and the back which is connected thereto about such vertical axis preferably is effected manually and the anti-friction nature of the support of plate 26, which is afforded by the bearing units 30, requires relatively little manual force to achieve the rotation, for example, from either sidewise position of the seat 14, into alignment with the longitudinal axis of leg rest 16 and, if desired, to the opposite sidewise position of the seat 14. Normally, there is no need to provide for any more than substantially 180° of rotation of the seat 14 about the vertical axis of tube 32 but, in accordance with the principles of the invention, rotation through a greater extent of rotary movement may be undertaken if desired, especially if suitable arrangements are made for permitting current to be transmitted from the power furnished to seat-elevating means 20, which is disposed upon base plate 12 so as to permit such greater amount of rotary movement. At present, by using a relatively, simple conduit, not shown, a flexible portion thereof extends suitably through the bracket plate 24 to the motor 86, such flexible portion of the conduit being of a sufficient extent to permit at least said aforementioned 180° of rotation.

Figure 3:
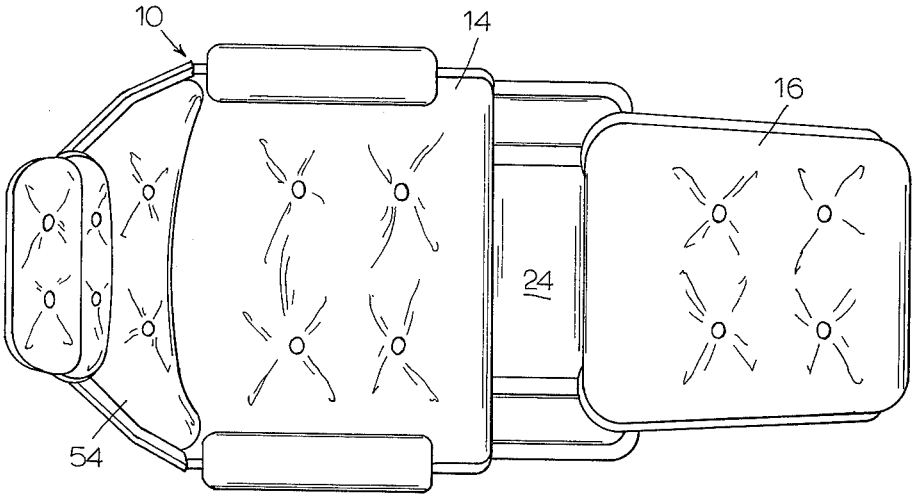
FIG. 3 is a top plan view of the chair shown in FIG. 1 and illustrating the front to back axis of the seat and longitudinal axis of the leg rest in alignment with each other.
Figure 11:
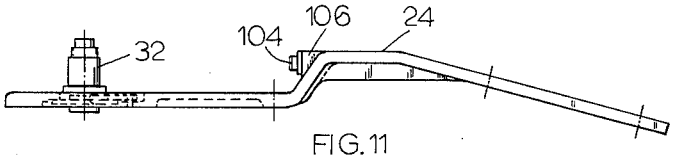
FIG. 11 is a side elevation of the mounting plate shown in FIG. 10.
Figure 10:
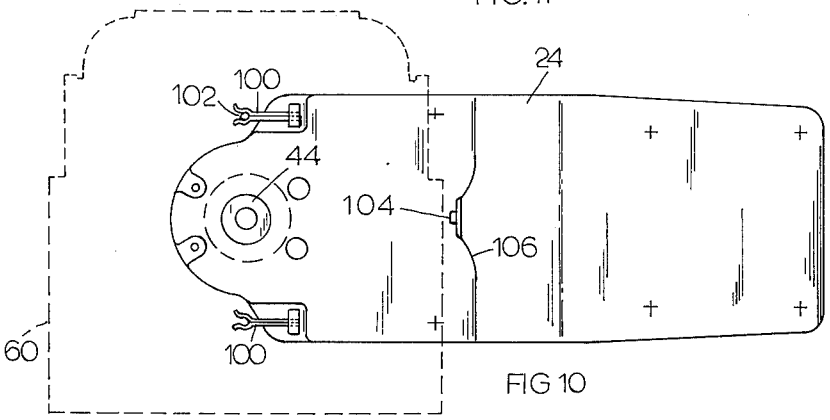
FIG. 10 is a top plan view of a mounting plate for the leg rest which is secured to the upper part of the base of the chair.

Although the rotary movement of the seat 14 and the back 18 which is connected thereto preferably is accomplished manually, it is desired that certain controls which preferably function automatically are included in the structure of the chair assembly 10, particularly to releasably retain the seat 14 in either of the sidewise positions thereof in which the front edge of the seat 14 is disposed in parallel relationship to the longitudinal axis of the leg rest 16, as illustrated in exemplary manner in FIG. 4, or to latch the seat 14 automatically with its longitudinal axis in alignment with the longitudinal axis of leg rest 16, as illustrated in exemplary manner in FIG. 3. Releasably latching the seat 14 in one or the other of the possible sidewise positions thereof, such as shown in FIG. 4, by referring to FIG. 10, it will be seen that the bracket plate 24 is provided with a plurality of leaf-spring yokes 100, into which a pin 102, which extends downward from the bottom surface of mounting plate 26, adjacent the rear edge thereof, as shown in FIGS. 5, 8 and 12, is releasably received, as illustrated in exemplary manner in FIG. 10. By exercising a very small amount of manual force, the pin 102 is readily removed from between the blades of the yoke 100 so that the mounting plate 26 which carries the seat and back readily may be swung toward the position shown in FIG. 3, and, when plate 26 reaches said position, it automatically is latched in such position by the following mechanism:

The aforementioned latching mechanism is best illustrated in FIGS. 5–7 and 11. In FIG. 11, it will be seen that a yieldable lug 104 is supported on a rearwardly extending projection 106, which is fixed to bracket plate 24. To cooperate with said lug, the rotatable mounting plate 26 carries a notched boss 108, the notch thereof being complementary to the lug 104 and the opposite sides of the boss 108 being tapered so as to provide cam surfaces which, during the approach of the boss 108 to the lug 104 will cammingly move the lug 104 into retracted position, against the action of spring 110, shown in FIGS. 6 and 7, until the notch of boss 108 centers relative to the lug 104 and then the latter is projected by the spring into said notch. Accordingly, such operation automatically latches the seat 14 in the position shown in FIG. 3 in which the longitudinal axis of the seat is in alignment with the longitudinal axis of the leg rest 16. If desired, the boss 108 and projection 106 may be interchanged within the spirit of the invention.

As described above, a patient normally is seated upon the seat 14 when the same is disposed sidewise, either toward one side or the other of the chair assembly 10, such as shown in FIG. 4, and then by elevating the patient's legs, as the seat 14 is moved from the position shown in FIG. 4 to that shown in FIG. 3, the legs will be in position to be disposed upon the leg rest 16 when the seat 14 reaches the position shown in FIG. 3, and automatically is latched in such position. The seat, with the patient therein, as well as the leg rest 16, then may be moved as a unit vertically by the mechanism included in the seat-elevating means 20, but not illustrated in detail herein, since the same comprises the subject matter of a companion application, now being prepared for filing.

Figure 7:
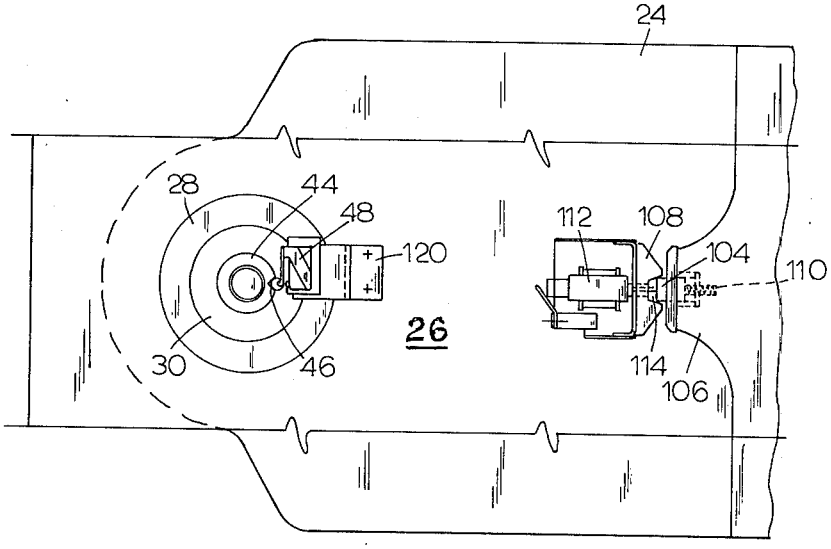
FIG. 7 is a fragmentary plan view illustrating the mechanism shown in FIG. 6 to present a more unobstructed view of the same than afforded by the showing in FIG. 5.

When the time arrives for the occupant of the chair to be removed therefrom the seat 14 is moved rotatably about its vertical axis from the position shown in FIG. 3 to that shown in FIG. 4, and this is accomplished by releasing the latch mechanism. A very simple arrangement is provided to accomplish this, as best shown in FIGS. 6 and 7, wherein it will be seen that, suitably supported upon the mounting plate 26, is a solenoid plunger unit 112, the plunger 114 of which normally is in retracted position, and either out of engagement with or merely touching the outer surface of latch 104. When the coil of the solenoid unit 112 is energized by suitable circuitry of a conventional type, which is operated by one of the switches included in the bank of switches 116, for example, shown in FIG. 1, the plunger 114 is projected forwardly to depress the latch 104 against the action of spring 110 sufficiently to remove it from the notch of the boss 108 but, by means described hereinafter, operation of said solenoid can occur only when the back 18 is in the upright position shown in FIGS. 1–4. As soon as the latch 104 has been removed from said notch, the plunger 114 will continue to bear upon the face of the latch 104 but may slide along said face until one of the corners of the boss 108, which defines the notch, engages the outer face of latch 104 and rotation of seat 14 then may continue until the seat reaches the position shown in FIG. 4, whereby the occupant of the chair may easily arise from the chair.

Reference has been made hereinabove to a bank of switches 116, illustrated in exemplary manner in FIG. 1. As shown, it will be seen that said bank is located vertically at a convenient position for engagement by an attendant or operator. Also, there preferably is a similar bank of switches respectively mounted at each side of the back 18 of the chair, whereby the same may be actuated conveniently from either side of the chair, depending upon where the attendant or operator is located. The various switches in the bank 116 thereof control the functioning of the motor 86 by which the back 18 and, correspondingly, the tiltable cushion plate 60 and the upholstered seat 14 attached thereto, are moved selectively in one of the two opposite directions of movement permitted by the construction. Also, one of the switch actuators of each bank 116 thereof controls the operation of the motor, not shown, by which the lowering and elevating mechanism enclosed with the seat-elevating means 20, is actuated. Further, the base portion of the seat-elevating means is provided respectively at each side with a foot-engageable switch actuating lever 118, but the switches, not shown, which are actuated thereby are connected in the circuit of the motor by which the seat-elevating means 20 is actuated, and the levers 118, therefore, preferably do not control or effect operation of the back 18 or seat 14.

Still further, the bank of switches 116 also include a switch actuating button connected in the circuit for the solenoid 112 which effects unlatching of the rotatable base unit 22 of the seat and back so as to permit rotation thereof relative to bracket plate 24, such rotation being about the vertical axis of the central tube 32, which is fixed to the bracket plate 24. Reference also has been made above to control switch 48, shown in FIGS. 6 and 7. Said switch has an actuator engageable with the notch 46 in the switch-operating cam 44. Said cam is stationary with respect to bracket plate 24 and the switch 48 is supported by a bracket 120 that is connected fixedly to the mounting plate 26, which comprises part of the rotatable base unit 22 of the seat 14, whereby the switch 48 moves with seat 14 as the same is moved toward and from the various positions permitted by the supporting structure therefor, as described above. Switch 48, however, primarily is a safety switch. When the switch actuator is aligned with notch 46, the switch is closed, but when the actuator is removed from the notch 46, the switch is open. The switch actuator is only aligned with notch 46 when the chair seat 14 is in the position shown in FIGS. 1 and 3, in which the front to back axis of the seat is aligned with the longitudinal axis of the seat rest 14. Also, switch 48 is in circuit with the circuit to the motor 86, see FIGS. 5 and 12, by which the back 18 and seat-tilting mechanism are operated. Therefore, due to the fact that the switch 48 is only closed, so as to complete a circuit, when the seat 14 and back are in the position shown in FIGS. 1 and 3 with respect to the leg rest 16, no movement of the back 18 or tilting of seat 14 can occur except when seat 14 and back 18 are in said aforementioned position but raising and lowering of the rotatable base unit 22 preferably can occur when the seat 14 and back are in either of the positions shown in FIGS. 1–4.

The reason for the foregoing circuit arrangement, especially the provision of the switch 48 and the cam notch 46 by which it is actuated is that if the seat 14 and back 18 were in the sidewise position, such as shown in FIGS. 2 and 4, or in the opposite sidewise position 180° about the vertical axis of the chair set 14, it would be possible for either a light and/or chair mount operating unit carried by the chair, or a heavy person seated in the chair, to overbalance the chair if the back were moved to supine position, for example, particularly in view of the fact that it is conventional for a dental chair and the like, to which the present invention pertains, to be disposed upon a supporting surface, such as a floor, simply by gravity, rather than being permanently attached thereto. However, when the seat and back of the chair are disposed in the position shown in FIGS. 1 and 3, and the back is inclined to supine position, it can be appreciated particularly from FIG. 1 that even though such equipment is on the chair or a heavy person is seated in the chair and the back is inclined rearwardly and downwardly to its fullest intended extent, the center of gravity of the chair, equipment and the occupant will not be located beyond the boundaries of the base member 12, due to the counterbalancing effect afforded by the leg rest 16, for example, as well as certain arrangements of the seat-elevating means 20, especially the motor housing 122 extending therefrom beneath the bracket plate 24 to further aid in counterbalancing the chair assembly under the foregoing circumstances.

CONTROL CIRCUITRY

Illustration of an electric circuit per se has not been included in the drawings, primarily because it is of substantially standard nature. Also, it is believed that a description of the operation of the various switches which have been included in the drawings will be adequate to afford an understanding of the operation of the various components of the chair comprising the invention and especially the safety and convenience features thereof, such description being set forth as follows, to supplement and summarize the various descriptions set forth hereinabove:

As stated above, the back 18 can only be reclined from upright position when the seat 14 is aligned with leg rest 16, as shown in FIGS. 1 and 3. This is due to the swich 48, see FIGS. 6 and 7, which is a normally closed type being held open by stationary cam 44 until the switch actuator drops into notch 46, thus closing the switch and completing a circuit to motor 86 when the BACK DOWN switch button of the bank 116 thereof is actuated at one side or the other of back 18. Seat 14 and back 18 thereon can be raised and lowered when in either position relative to leg rest 16 by actuating switch lever 118 at the rear of base 12 in one of two possible directions, respectively and selectively to close switches, not shown, in circuits to the motor in housing 122 to raise or lower said seat and back by the seat-elevating means 20.

Moving back 18 relative to seat 14 between upright and inclined positions, as well as tilting seat 14 between horizontal and sloping positions, is effected by motor 86 mounted beneath seat 14 within base unit 22. Such movement of back 18 from upright to reclining or supine position is initiated by actuating BACK DOWN switch button in bank 116 thereof at opposite sides of back 18 but only when the actuator of switch 48 is in notch 46 of cam 24. Motor 86 thereby is energized to effect such reclining movement as long as the BACK DOWN switch button of the bank is held to hold the switch thereof closed, or until a limit switch 132 is engaged by forward movement of nut 94 which travels along screw 92. Such engagement of switch 132 opens the circuit to motor 86 and stops operation thereof.

Switch 126 is one of a group of three switches which are operable by nut 94 when it reaches the rearmost position thereof. The other switches are designated 124 and 128 in FIG. 12. Switch 124 is in the circuit of solenoid plunger unit 112 which operates latch plunger 114 and is a normally open type. When the actuator of switch 124 is engaged by nut 94, the switch is closed to complete a circuit between the switch of SWIVEL RELEASE button of bank 116 and solenoid 112, whereby pressing said button energizes the solenoid and latch lug 104 is pushed by solenoid plunger 114 to released position and thereby frees the chair seat for swivel movement about its vertical axis.

The third switch 128 in said group shown in FIG. 12, when closed, acts as an interlock between the respective circuits to motor 86 and the motor in housing 122, to insure that each motor may complete the desired movement of elements actuated thereby, irrespective of whether the other motor has completed its function and has stopped.

When the back 18 is moved from inclined position toward upright position, the aforementioned switch 126, which is one of the group of three switches operable by the nut 94, as indicated above, is engaged by nut 94 when it reaches its rearmost intended position. Said switch is in the motor 86, and, unless the movement of the back 18 to the upright position is interrupted before full movement thereof, such as by releasing the aforementioned BACK UP switch button of the bank 116 thereof, such forward movement of the back 18 ultimately will be stopped when nut 94 engages the actuaator of said limit switch 126.

From the foregoing, it will be seen that the present invention provides a highly useful and convenient arrangement by which a person may be seated in an operatory chair, such as a dental chair or the like, while the same is disposed sidewise with respect to a leg rest, which extends laterally from the base. Then, by the person elevating his legs outwardly from the chair, the seat and back of the chair may be rotated 90°, for example, so that the person's legs are disposed immediately above the leg rest and then may be lowered onto the rest. Seating a patient in the foregoing manner is much more convenient and expeditious than under circumstances where the seat of the chair is permanently in axial alignment with the leg rest, especially in chairs wherein the leg rest is a continuation of the forward portion of the seat of the chair. An operator or attendant may perform certain desired operations in the oral cavity, for example, of the person seated in the chair while the chair seat is disposed sidewise with respect to the leg rest, as described above. Further, releasable latch means are provided to maintain the chair either in the aforementioned sidewise position or in the operative position in which the seat of the chair is aligned longitudinally with the axis of the leg rest. One of said latches is electrically operated to release the same and the other one is preferably of a frictional nature.

In addition to the foregoing, the back of the chair is pivotally connected to the rear edge of the seat and movement of the same between substantially upright and supine positions is performed by power means activated by the electric motor through the means of gear reduction and simple mechanical mechanism, and in addition to the back being pivotally movable relative to the seat, such pivotal movement of the back also affects automatic variations in a tilting disposition of the seat cushion relative to the horizontal, such tilting movement being accomplished automatically, incident to the pivotal movement of the back. Safety circuit means also are included, together with conveniently located switch operating means by which the electrical operating mechanism of the chair is easily and conveniently controlled.

While the invention has been described and illustrated in its several preferred embodiments, it should be understood that the invention is not to be limited to the precise details herein illustrated and described since the same may be carried out in other ways falling within the scope of the invention as illustrated and described.

We claim:

1. An adjustable chair comprising in combination a base having an upper portion movable vertically relative to the lower portion thereof, a seat unit supported upon said upper portion of said base for direct vertical movement therewith, a back pivotally connected to the normally rear edge of the seat, an elongated support having one end extending laterally from said upper portion of said base, meas fixedly connecting the other end of said support to said upper portion of said base, a leg rest connected to said one end of said support for support of said leg rest substantially in horizontal alignment with said seat unit, and means connecting said seat to said upper portion of said base for pivotal movement about a substantially vertical axis between a first position in which the front to rear axis of said seat is aligned with the longitudinal axis of said leg rest and a second position in which said front to rear axis of said seat is disposed tranversely to the axis of said leg rest to facilitate a person sitting upon said seat without obstruction by said leg rest when said seat is in said second position.

2. The chair according to claim 1 in which said elongated support comprises a rigid bracket plate and one end thereof is secured to said upper portion of said base and extending laterally therefrom to support said leg rest.

3. The chair according to claim 2 in which said leg rest is disposed upon the upper surface of said bracket plate and the inner edge of said leg rest thereon is spaced a limited distance from the front edge of said seat when said seat is aligned with said rest to facilitate rotary movement of said seat about the axis of said base.

4. The chair according to claim 3 in which said seat and leg rest are upholstered and when said seat is aligned with said leg rest, the upper surfaces of the upholstery on said seat and leg rest are disposed substantially within a common plane compatible with the buttocks and legs of a person when seated upon said seat and leg rest with the legs outstretched and resting upon said leg rest.

5. The chair according to claim 2 in which said bracket plate has an upwardly offset portion intermediately of the opposite ends thereof and further including latch means having interengageable elements respectively carried by one face of said rotatable seat and said offset portion of said bracket plate and operable to secure said seat releasably in a predetermined position relative to said leg rest.

6. The chair according to claim 5 in which said latch elements are engageable only when the aforementioned axes of said seat and leg rest are aligned and the front of said seat is adjacent said leg rest.

7. The chair according to claim 5 in which are of said latch elements is movable axially for reception of the outer end thereof in a notch in the other latch element, said one of said latch elements being spring-pressed outwardly and said notched latch element having cam surfaces to facilitate engagement of said latch elements.

8. The chair according to claim 7 further including an electrical solenoid connected to a movable plunger on said notched latch element and operable to push said latch element from the confines of said notch of the other latch element and thereby release it from said notched element and permit rotation of said seat relative to said leg rest.

9. The chair according to claim 8 further including means to raise and lower said seat relative to said base, an electric switch having an actuating member, a circuit between said switch and solenoid and connectable to a source of current, a cam on said seat engageable with said actuating member of said switch, power means comprising an electric motor interconnected to said seat and operable to tilt said seat and pivotally move said back relative to said seat, said electric motor also being connected in said circuit for said solenoid and said switch being operable to prevent operation of said motor to actuate said seat and back as aforesaid except when the axial alignment of the axes of said seat and leg rest disposes said cam and said actuating member of said switch in position to close said switch and thereby establish a circuit to said motor.

10. The chair according to claim 9 further including additional control switch means connected in said circuit and operable to effect raising and lowering of said seat by said motor, said control switch means being located on at least one side of said back member.

* * * * *